US005890533A

United States Patent [19]

Jones

[11] Patent Number: 5,890,533

[45] Date of Patent: Apr. 6, 1999

[54] ALTERNATE PATH WELL TOOL HAVING AN INTERNAL SHUNT TUBE

[75] Inventor: Lloyd G. Jones, Dallas, Tex.

[73] Assignee: Mobil Oil Corporation, Fairfax, Va.

[21] Appl. No.: 902,474

[22] Filed: Jul. 29, 1997

[51] Int. Cl.[6] ..... E21B 43/04

[52] U.S. Cl. ..... 166/51; 166/233

[58] Field of Search ..... 166/51, 56, 157, 166/205, 227, 231, 233, 235

[56] References Cited

U.S. PATENT DOCUMENTS

| | | | |
|---|---|---|---|
| 4,945,991 | 8/1990 | Jones . | |
| 5,082,052 | 1/1992 | Jones et al. | 166/51 |
| 5,113,935 | 5/1992 | Jones et al. . | |
| 5,333,688 | 8/1994 | Jones et al. . | |
| 5,341,880 | 8/1994 | Thorstensen et al. | 166/51 X |
| 5,390,966 | 2/1995 | Cox et al. | 166/241.6 X |
| 5,417,284 | 5/1995 | Jones . | |
| 5,419,394 | 5/1995 | Jones . | |
| 5,476,143 | 12/1995 | Sparlin et al. . | |
| 5,515,915 | 5/1996 | Jones et al. . | |
| 5,588,487 | 12/1996 | Bryant | 166/51 |

*Primary Examiner*—Roger Schoeppel
*Attorney, Agent, or Firm*—Malcolm D. Keen

[57] ABSTRACT

A gravel-pack, well screen having an internal shunt tube positioned inside the screen for delivering gravel slurry to different levels within the well annulus during a gravel pack operation. The screen includes one or more joints with each joint includes a base pipe having a screen section therein. The internal shunt extends substantially throughout the length of the base pipe. Bolts, each having a passage therethrough, provide fluid passages between the exterior of the screen and the internal shunt tube near either end of the base pipe. During operation, slurry enters the internal shunt tube through the uppermost bolt and exits into the annulus through the passages in the lower bolts to distribute gravel to to different levels of the annulus.

13 Claims, 2 Drawing Sheets

ALTERNATE PATH WELL TOOL HAVING AN INTERNAL SHUNT TUBE

DESCRIPTION

1. Technical Field

The present invention relates to a well tool for fracturing and/or gravel packing a well and in one of its aspects relates to an alternate-path well tool for fracturing and/or gravel packing a well which has an internal shunt tube for delivering a particulate-laden, fluid at spaced points within the wellbore annulus which surrounds the well tool.

2. Background

In producing hydrocarbons or the like from certain subterranean formations, it is not uncommon to produce large volumes of particulate material (e.g. sand) along with the formation fluids. The production of this sand must be controlled or it can seriously affect the economic life of the well. One of the most commonly-used techniques for sand control is one which is known as "gravel packing".

In a typical gravel pack completion, a screen is positioned within the wellbore adjacent the interval to be completed and a slurry of particulate material (i.e."gravel"), is pumped down the well and into the annulus which surrounds the screen. As liquid is lost from the slurry into the formation and/or through the screen, the gravel from the slurry is deposited around the screen to form a permeable mass around the screen which allows produced fluids to flow through the gravel mass while substantially blocking the flow of any particulate material, A major problem in gravel packing—especially where long or inclined intervals are to be completed—lies in adequately distributing the gravel over the entire completion interval, i.e. completely packing the well annulus along the length of the screen. Poor distribution of gravel (i.e. voids in the gravel pack) is often caused when liquid from the gravel slurry is lost prematurely into the more permeable portions of the formation thereby causing "sand bridges" to form in the annulus before all of the gravel has been placed. These sand bridges effectively block further flow of the slurry through the annulus thereby preventing delivery of gravel to all parts of the annulus surrounding the screen.

To alleviate this problem, "alternate-path" well tools (e.g. well screens) have now been developed which provide good distribution of gravel throughout the entire completion interval even when sand bridges form before all of the gravel has been placed. In alternate-paths well tools, perforated shunts or by-pass conduits extend along the length of the tool which receive gravel slurry as it enters the well annulus. If a sand bridge forms in the annulus, the slurry can pass through the perforated shunt tubes to be delivered to different levels in the annulus above and/or below the bridge. For a more complete description how such well tools (e.g. gravel-pack screens) operate, see U.S. Pat. No. 4,945,991 which is incorporated herein by reference.

In many prior-art, alternate-path well screens, the individual shunts tubes are carried externally on the outer surface of the screen; see U.S. Pat. Nos. 4,945,991; 5,082,052; 5,113,935; 5,417,284; and 5,419,394. While this arrangement has proven highly successful, externally-mounted shunts do have some disadvantages. For example, by mounting the shunts externally on the screen, the effective, overall outside-diameter of the screen is increased. This can be very important especially when the screen is to be run into a relatively small-diameter wellbore where even fractions of an inch in its diameter may make the screen unusable or at least difficult to install in the well.

In order to keep the effective diameter of a tool as small as possible, external shunt tubes are typically formed from "flat" rectangular tubing even though it is well. recognized that it is easier and substantially less expensive to manufacture a round tube and that a round tube has a substantially greater and a more uniform burst strength than does a comparable rectangular tube.

Another disadvantage in mounting the shunts externally, be they round or rectangular, is that the shunts are thus exposed to damage during assembly and installation of the screen. If the shunt is crimped during installation or bursts under pressure during operation, it becomes ineffective in delivering the gravel to all of the levels in the completion interval and may result in in the incomplete packing of the interval. One proposal for protecting these shunts is to place them inside the outer surface of the screen; see U.S. Pat. Nos. 5,476,143 and 5,515,915. However, this can substantially increase the cost of the screen without substantially decreasing the overall diameter of the screen.

SUMMARY OF THE INVENTION

The present invention provides a gravel-pack, well screen having a shunt tube positioned inside the screen for delivering gravel slurry to different levels within the annulus surrounding the screen when the screen is positioned adjacent the formation to be completed. The distribution of gravel directly to the various levels in the annulus from the internal shunt tube provides a better distribution of gravel throughout the completion interval especially when sand bridges form in the annulus before all of the gravel has been placed.

Also, by placing the internal shunt tube inside the base pipe of the screen, (a) the shunt is protected from damage and abuse during handling and installation of the gravel pack screen; (b) the shunt does not increase the effective diameter of the screen; (c) a more-desirable "round" tube can be used to form the internal shunt thereby providing a shunt with a greater burst strength and a less chance of failure during operation than most external shunts; and (d) the shunt can be sealed with respect to inside the screen so there is no need to close the inlet or the outlets from the internal shunt tube at the conclusion of the gravel pack operation to prevent gravel or particulates from entering the screen.

More specifically, the well screen of the present invention is comprised of one or more joints with each joint being comprised of a permeable base pipe having a screened section therein (e.g. wire wrapped around the base pipe). A threaded coupling or the like is provided on either end of the base pipe to connect adjacent joints together. A length of internal base pipe (e.g. conduit having a round, cross-section) is positioned inside the base pipe and extends substantially throughout the length of the base pipe. A threaded connector or the like is provided on either end of the length of the internal shunt tube to connect the adjacent lengths of shunt tube together.

The length of internal shunt tube is positioned within the base pipe so that the connector on the shunt tube will be aligned with the coupling on the base pipe. Openings are either preformed in both the connector and the coupling and then aligned or both openings are formed (e.g. drilled) after the connector and the coupling are aligned during assembly. An elongated element, e.g. a threaded bolt having an open, axial passage therethrough, is passed through the aligned openings to provide a fluid communication passage between the interior of the internal shunt tube and the exterior of the well screen. A sealing means, e.g. gasket(s), is provided to prevent leakage of gravel or other particulate material around the bolt into the interior of the screen. In some instances, external shunts tubes may also be provided on the well screen.

In operation, the well screen is assembled and lowered into the wellbore to a position adjacent the interval to be gravel packed. Gravel slurry is then pumped down the wellbore and into the annulus surrounding the screen. Slurry enters the internal shunt tube through an inlet (i.e. the uppermost fluid communication passage to the internal shunt) and flows downward through the internal shunt to exit into the annulus at each of the outlet passages which lead from the internal shunt tube to the exterior of the screen.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
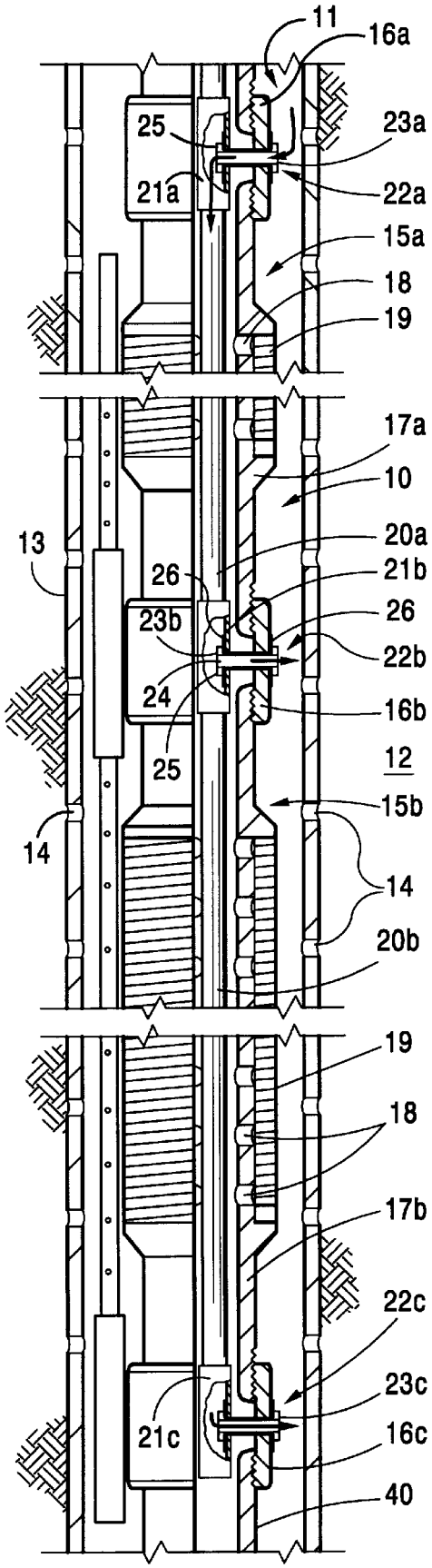
FIG. 1 is an elevational view, partly in section, of a well tool in accordance with the present invention.

Referring more particularly to the drawings, FIG. 1 illustrates the present well tool 10 in an operable position within the lower end of a producing and/or injection wellbore 11. Wellbore 11 extends from the surface (not shown) and into or through formation 12. Wellbore 10, as shown, is cased with casing 13 having perforations 14 therethrough, as will be understood in the art. While wellbore 11 is illustrated as being substantially vertical, cased well, it should be recognized that the present invention can be used equally as well in "open-hole" and/or underreamed completions as well as in horizontal and/or inclined wellbores.

Well tool 10 (e.g. gravel pack screen) may be of a single length or it may be comprised of several joints (e.g. 15*a*, 15*b* in FIG. 1) which are connected together with threaded couplings 16 or the like. As shown, each joint 15 of gravel pack screen 10 is basically identical to each other and each is comprised of a perforated base pipe 17 having a continuous length of a wrap wire 19 wound thereon which forms a "screened" section therein. While base pipe 17 is shown as one having a plurality of perforations 18 therein, it should be recognized that other types of permeable base pipes, e.g. slotted pipe, etc., can be used without departing from the present invention.

Each coil of the wrap wire 19 is slightly spaced from the adjacent coils to thereby form fluid passageways (not shown) between the respective coils of wire as is commonly done in many commerically-available, wire-wrap screens, e.g. BAKERWELD Gravel Pack Screens, Baker Sand Control, Houston, Tex. Again, while one type of screen 10 has been specifically described, it should be recognized that the term "screen" as used throughout the present specification and claims is meant to be generic and is intended to include and cover all types of similar structures commonly used in gravel pack operations (e.g. commercially-available screens, slotted or perforated liners or pipes, screened pipes, prepacked or dual prepacked screens and/or liners, or combinations thereof).

Referring again to FIG. 1, joints 15*a*, 15*b* have a length of at least one internal shunt tube 20*a*, 20*b*, respectively, positioned within base pipes 17*a*, 17*b*, respectively, and extends substantially therethrough. Shunt tube 20 is preferably a round tube which has uniform burst strength throughout its length whereby it is less likely to fail during operation. Each length of shunt tube 20 is adapted to be fluidly connected to an adjacent length of shunt tube by a threaded shunt connector 21 (e.g. 21*b*) or the like which, in turn, is adapted to lie adjacent a respective base pipe coupling (e.g. 16*b*) when screen 10 is properly assembled.

A passage 22 (e.g. outlet 22*b*) is provided at each shunt coupling 21 throughout screen 10 and extends through both the coupling 21 and the adjacent base pipe coupling 16. Passage 22 provides fluid communication between the interior of internal shunt tube 20 and the exterior of well screen 10 for a purpose described below. As shown, outlet 22 is comprised of a "hollow" elongated element, e.g. bolt 23 or the like, having an open, axial passage 24 therethrough.

In assembling well screen 10, the lower end of the lowermost joint 15*c* of well screen 10 is either closed or is adapted to be connected to a lower string of well pipe 40 as will be understood in the art. The lower end of internal shunt tube 20*b* is closed with a threaded cap 21*c* or the like and shunt connector 21*b* is threaded onto its upper end. Shunt tube 20*b* is then positioned inside base pipe 17*b* so that the shunt connector 21*b* will lie adjacent to base pipe coupling 16*b*.

An opening may be preformed in both coupling 16*b* and connector 21*b* which are to be aligned when internal shunt tube 20*b* is in position within base pipe 17*b*. Alternately, these openings can be drilled or otherwise provided through both the base pipe coupling and the shunt tube connections in a single operation after they are aligned as the screen is being made-up. Bolt 23*b* is passed through these aligned openings to form passage 22*b*. Bolt 23 can be either threaded directly into the opening in shunt connector 21 (lower bolt 23*c* in FIG. 1) or a nut 25 (upper bolts 23*a*, 23*b*) can be used to secure it in place. Gaskets 26 or other sealing means can be used, if necessary, to prevent leaking of fluids (i.e. particulates) around the bolt into the interior of base pipe 17 during installation into a wellbore. The lower passage 22*c* is installed before the lowermost joint 15*b* is closed or assembled into the lower wellstring. It can be seen that the open, axial passages 24 through the respective bolts 23 will provide fluidly communication between the interior of internal shunt tube 20 and the exterior of well screen 10 at each of the base pipe couplings 16.

The lower end of the next adjacent length of shunt tube, i.e. 20*a*, is then threaded into shunt connector 21*b* before the next adjacent joint 15*a* is lowered over internal shunt tube 20*a*. The base pipe 17*a* of joint 15*a* is threaded into base pipe coupling 16*b* and the above-described procedure is repeated until the desired length of well screen 10 has been assembled. The upper end of the uppermost length, e.g. 20*a*, of internal shunt tube 20 will be closed by a threaded cap 21*a* or the like and bolt 23*a* will form an "inlet" passage 22*a* for a purpose described below.

In some instances, it may be desirable to also include one or more external perforated shunts 30 (only one shown) of the type commonly found in prior-art, alternate-path screens. Shunt(s) 30 is positioned along the external surface of screen 10 and is adapted to carry slurry to different levels within a wellbore; see U.S. Pat. Nos. 4,945,991, 5,113,935, and 5,419,394 which are incorporated herein by reference. In such instances, rectangular tubes are preferably used to form external shunt 30 so that the outer diameter of the screen is not increased over that of the prior-art screens having similar external shunts. However, in the present invention, if shunt (s) 30 is damaged during installation or bursts during the gravel packing operation, slurry can still be delivered through the internal shunt 20 to different levels within annulus 35 to complete the gravel pack operation.

A typical gravel pack operation using the present invention will now be set forth. Screen 10 is assembled and lowered into wellbore 11 on a workstring (not shown) and is positioned adjacent formation 12. A packer (not shown) can be set if needed as will be understood in the art. Gravel slurry is then pumped down the workstring, out through a cross-over or the like (not shown), and into the annulus 35 around well screen 10. The upper end of each of the external shunt tubes 30, if present, is typically open to receive the gravel slurry as it enters annulus 35 or can be manifolded directly to the outlets in the cross-over and will carry slurry to different levels in the annulus.

As the gravel slurry flows downward in annulus 35 around the screen 10, it will lose liquid to formation 15 and/or through the screen, itself. The gravel carried in the slurry is deposited and collects in the annulus to form the gravel pack around the screen 10. If too much liquid is; lost from the slurry before the annulus is filled, a sand bridge (not shown) is likely to form in the annulus 35 thereby blocking further flow therethrough which, in turn, prevents further filling of the annulus below the bridge.

In the present invention, if a sand bridge forms before the gravel packing has been completed, the gravel slurry can continue to flow downward through shunt tube(s) 20 and out the respective outlets 22 to thereby by-pass the bridge and complete the gravel pack. The slurry (see heavy arrows) will enter into internal shunt tube 20 through inlet 22*a* and will exit through each of the outlets, e.g. 22*b*, 22*c*, at different levels within the annulus 35.

The distribution of gravel directly to the various levels in the annulus from internal shunt tube 20 provides a better distribution of gravel throughout a completion interval especially when sand bridges may form in the annulus before all of the gravel has been placed. Also, since internal shunt tube 20 is positioned within the base pipe of the screen, it is protected from damage and abuse during handling and installation of the gravel pack screen. Further, by positioning the shunt inside the base pipe, it does not increase the effective diameter of the screen. This allows a more-desirable "round" tube to be used to form shunt 30 thereby providing a shunt with a greater burst strength and a less chance of failure during operation than most external shunts. Still further, since the shunt is sealed with respect to flow inside the screen, there is no need to close the inlet or the outlets of the internal shunt tube at the conclusion of the gravel pack operation since no gravel or particulates can enter the screen from the shunt or its associated passages.

Figure 2:
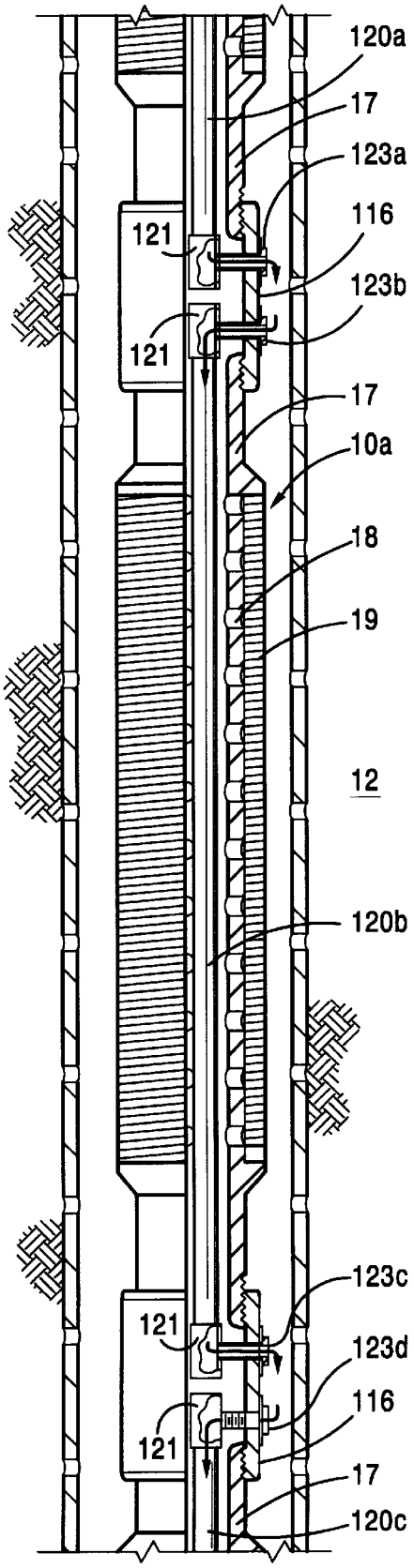
FIG. 2 is an elevational view, partly in section, of another embodiment of a well tool in accordance with the present invention.

FIG. 2 illustrates another embodiment of the present invention which is similar to that shown in FIG. 1 except internal shunt 120 is comprised of lengths of tubing, (e.g. round tubes 120*a*, 120*b*, 120*c*) which are closed at both ends by threaded caps 121. As before, aligned openings are provided through both the base pipe coupling 116 and the caps 121 and hollow bolts 123 or the like are positioned therethrough to provide fluid communication between the shunt and the exterior of the screen. In operation, slurry will enter shunt 120 at the upper end (not shown) of the uppermost joint of the screen and flow through the first length of shunt 120, e.g. 120*a*) and exit through bolt 123*a*. The slurry may then enter the second length of the shunt, e.g. 120*b*, at it upper end through bolt 123*b* and exit at its lower end through bolt 123*c*, and so on through the entire length of the screen 110.

What is claimed is:

1. A well screen comprising:

a base pipe having a screened section therein;

an internal shunt tube positioned inside said base pipe and extending substantially throughout the length of said base pipe; and means for fluidly communicating the interior of said shunt tube with the exterior of said well screen wherein said means comprises:

an elongated element having a passage therethrough.

2. The well screen of claim 1 wherein said element comprises:

a bolt having a longitudinal passage therethrough.

3. The well screen of claim 2, including:

a coupling on one end of said base pipe;

a connector on one end of said internal shunt tube adapted to be aligned when said internal shunt tube is positioned inside said base pipe;

openings in said coupling and said connector which are aligned when said internal shunt tube is positioned inside said base pipe, said bolt being positioned through said aligned openings.

4. A well screen comprising:

at least one joint, said joint comprising:

a base pipe having a screen section thereon;

a coupling on one end of said base pipe adapted to connect said base pipe to another joint;

an internal shunt tube positioned within said base pipe and extending substantially through the length of said base pipe;

a connector on one end of said internal shunt tube and adapted to be aligned with said coupling on said base pipe when said internal shunt tube is positioned within said base pipe;

openings in both said connector and said coupling and adapted to be aligned when said internal shunt tube is positioned within said base pipe; and means passing through said aligned openings to prod a passage for fluidly communicating said shunt tube with the exterior of said well screen wherein said means comprises an elongated element having a passage therethrough.

5. The well screen of claim 4 including:

at least one external perforated shunt tube positioned externally of said base pipe.

6. The well screen of claim 4 wherein said element comprises:

a bolt having a longitudinal passage therethrough.

7. A well screen comprising:

a plurality of joints, each of said joints comprising:

a base pipe having a screen section thereon;

a coupling on one end of said base pipe for connecting two adjacent joints together;

a length of an internal shunt tube positioned within said base pipe and extending substantially through the length of said base pipe;

a connector on one end of said internal shunt for connecting two adjacent lengths of said internal shunt tube together and being aligned with said coupling on said base pipe;

openings in both said connector and said coupling; and means passing through said aligned openings to provide a passage for fluidly communicating said internal shunt tube with the exterior of said well screen wherein said means comprises an elongated element having a passage therethrough.

8. The well screen of claim 7 wherein said element comprises:

a bolt having a longitudinal passage therethrough.

9. The well screen of claim 8 wherein said bolt is threaded into said opening in said connector.

10. The well screen of claim 9 wherein said bolt passes through said opening in said connector and is secured by a nut.

11. The well screen of claim 8 including:

means for preventing flow between said openings and said bolt.

12. The well screen of claim 11 wherein said sealing means comprises:

at least one gasket.

13. The well screen of claim 12 including:

at least one external perforated shunt tube positioned externally of said base pipe.

* * * * *